US010362851B2

(12) United States Patent
Tarling et al.

(10) Patent No.: US 10,362,851 B2
(45) Date of Patent: Jul. 30, 2019

(54) SQUEEZABLE NAIL TREATMENT CONTAINER

(71) Applicant: L'OREAL, Paris (FR)

(72) Inventors: Christopher Tarling, Clark, NJ (US); Marisol Simard, Upper Nyack, NY (US)

(73) Assignee: L'OREAL, Paris (FR)

( * ) Notice: Subject to any disclaimer, the term of this patent is extended or adjusted under 35 U.S.C. 154(b) by 437 days.

(21) Appl. No.: 15/056,605

(22) Filed: Feb. 29, 2016

(65) Prior Publication Data

US 2017/0245617 A1 Aug. 31, 2017

(51) Int. Cl.

| | |
|---|---|
| ***A45D 29/18*** | (2006.01) |
| ***A45D 29/00*** | (2006.01) |
| ***B65D 51/32*** | (2006.01) |
| ***B65D 43/02*** | (2006.01) |

(52) U.S. Cl.

CPC ..... *A45D 29/007* (2013.01); *B65D 43/0225* (2013.01); *B65D 51/32* (2013.01); *A45D 2200/1009* (2013.01); *A45D 2200/1063* (2013.01)

(58) Field of Classification Search

CPC ..... A45D 29/007; A45D 2200/1009; A45D 2200/0225; B65D 43/0225; B65D 51/32

USPC ..... 401/7, 9

See application file for complete search history.

(56) References Cited

U.S. PATENT DOCUMENTS

| | | | | |
|---|---|---|---|---|
| 4,440,181 A | | 4/1984 | Scherer | |
| 4,530,726 A | * | 7/1985 | Montiel | A45D 29/007 132/73.5 |
| 4,671,306 A | * | 6/1987 | Spector | A45D 29/007 132/73 |
| 4,964,372 A | * | 10/1990 | Zeenni | A45D 29/007 132/74.5 |
| 5,054,503 A | | 10/1991 | Keller | |
| 5,246,139 A | | 9/1993 | Duceppe | |
| 5,806,536 A | | 9/1998 | Tietjen | |
| 2006/0076029 A1 | * | 4/2006 | Barclay | A45D 29/007 132/74.5 |

FOREIGN PATENT DOCUMENTS

| | | |
|---|---|---|
| CA | 2439837 A1 | 3/2005 |
| EP | 0049759 A2 | 4/1982 |
| EP | 0 526 149 A1 | 2/1993 |

OTHER PUBLICATIONS

International Search Report and Written Opinion dated Jun. 8, 2017 in PCT/IB2017/000229.

* cited by examiner

*Primary Examiner* — Rachel R Steitz
(74) *Attorney, Agent, or Firm* — Oblon, McClelland, Maier & Neustadt, L.L.P.

(57) ABSTRACT

An apparatus is provided for providing nail or skin treatment. The apparatus includes a container, formed of a compressible material; an insert, disposed within the container formed of a compressible material, and configured to receive and surround at least one body part of the user; and an opening at a first end of the container which provides access to an interior surface of the insert, wherein the insert is configured to hold at least one substance configured to treat at least one of a nail and skin of the user.

13 Claims, 8 Drawing Sheets

SQUEEZABLE NAIL TREATMENT CONTAINER

BACKGROUND

Field

The present disclosure is directed toward a squeezable nail treatment container apparatus and method.

SUMMARY

In an embodiment, an apparatus is provided for providing nail or skin treatment, comprising: a container, formed of a compressible material; an insert, disposed within the container formed of a compressible material, and configured to receive and surround at least one body part of the user; and an opening at a first end of the container which provides access to an interior surface of the insert, wherein the insert is configured to hold at least one substance configured to treat at least one of a nail and skin of the user.

In an embodiment, the apparatus further includes a lid assembly configured to connect to the container and cover the opening, and to hold a detail sponge that is disposed within the insert when the lid assembly is connected to the container.

In an embodiment, the lid assembly further includes: a rod insert, wherein the rod insert that is configured to support the detail sponge and to protrude away from the opening and into the insert when the lid assembly is attached to the container.

In an embodiment, the rod insert supports the detailed sponge by attaching to the detailed sponge at a protruding end of the rod insert.

In an embodiment, the rod insert supports the detail sponge by the detail sponge surrounding a protruding portion of the rod insert.

In an embodiment, the lid assembly is configured to connect to the container by a press fit.

In an embodiment, the lid assembly is configured to connect to the container by screw threads.

In an embodiment, the insert is made of spongy material.

In an embodiment, the insert further includes: an inner sponge; and an outer sponge, wherein the inner sponge is disposed within the outer sponge, and an interface between an outer surface of the inner sponge and an inner surface of the outer sponge is configured to receive multiple fingers of the user simultaneously and allow movement of the multiple fingers along the interface.

In an embodiment, the insert comprises a hole that coincides with the opening of the container and is configured to receive the at least one body part of the user.

In an embodiment, the apparatus further includes at least one slit disposed in the insert, wherein one end of the slit feeds into the hold.

In an embodiment, the compressible material of the container is a polyamide.

In an embodiment, the at least one substance is a solvent.

In an embodiment, the solvent is ethanol acetate.

In an embodiment, the container is configured to translate a compression force received at an outer surface to the insert to compress the insert upon the at least one body part of the user.

In an embodiment, a method is provided for providing nail or skin treatment to a user, implemented by an apparatus that includes a container, formed of a compressible material; an insert, disposed within the container formed of a compressible material, and configured to receive and surround at least one body part of the user; and an opening at a first end of the container which provides access to an interior surface of the insert, wherein the insert is configured to hold at least one substance configured to treat at least one of a nail and skin of the user. The method includes translating a compression force received at an outer surface to the insert to compress the insert upon the at least one body part of the user; applying the substance to the at least one body part of the user when the compression force is received.

The foregoing general description of the illustrative implementations and the following detailed description thereof are merely exemplary aspects of the teachings of this disclosure, and are not restrictive.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings wherein.

DETAILED DESCRIPTION

Figure 1A:
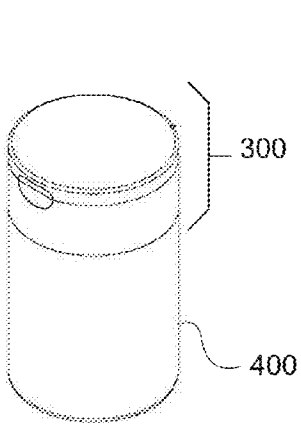
FIG. 1A is a perspective view of a squeezable nail treatment apparatus, according to one example.

In the drawings, like reference numerals designate identical or corresponding parts throughout the several views. Further, as used herein, the words "a", "an" and the like generally carry a meaning of "one or more", unless stated otherwise. Further, the word nail or nails, as used herein, refers to either finger nails or toenails.

Referring now to the drawings, wherein like reference numerals designate identical or corresponding parts throughout the several views.

FIGS. 1A through 1F show nail treatment apparatuses in which one or more methodologies or technologies can be implemented such as, for example, having a squeezable container including a squeezable inner component (e.g., an inner sponge, a deformable insert, an elastic member, a memory polymeric substrate, and the like. In an embodiment, methodologies or technologies include deformable nail treatment apparatuses that enables a user to apply a force (e.g., a normal force, a tangential force, a frictional force, and the like) on an object, a finger, a nail, and the like received within the nail treatment apparatuses. In an embodiment, methodologies or technologies including a deformable nail treatment apparatus that enhances the effectiveness of a cosmetic formulation, polish remover, a nail treatment formulation, or the like received within the nail treatment apparatuses.

FIG. 1A is a perspective view of a nail treatment apparatus 100*a*, according to one example. The nail treatment apparatus 100*a* includes an enclosure 300 and a squeezable container 400. The squeezable container 400 is substantially cylindrical in shape along the Y-axis. An enclosure 300 is disposed at a first end of the squeezable container 400, connected in such a way as to form an airtight seal between the enclosure 300 and the squeezable container 400. Further, the enclosure 300 is shown in a closed position.

Figure 1C:
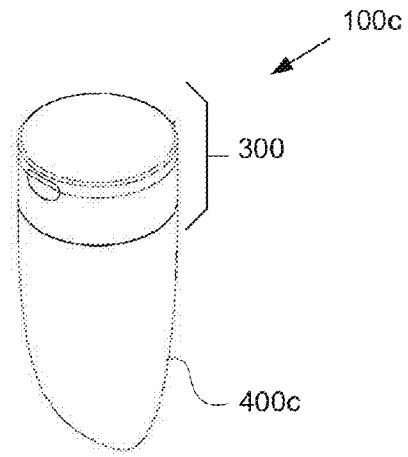
FIG. 1C is a perspective view of a squeezable nail treatment apparatus, according to one example.
Figure 1E:
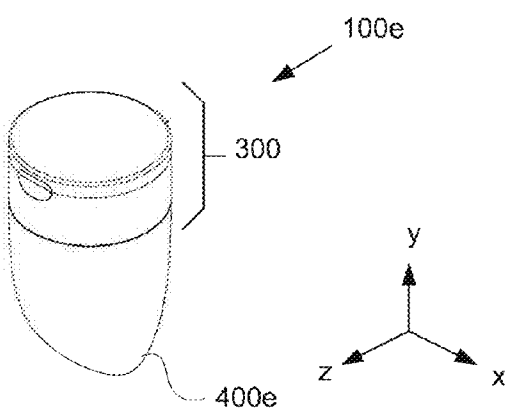
FIG. 1E is a perspective view of a squeezable nail treatment apparatus, according to one example.
Figure 1B:
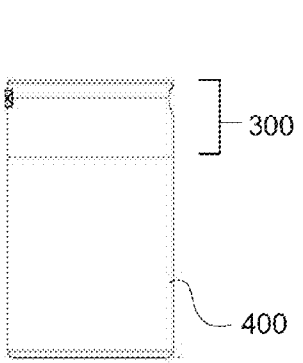
FIG. 1B is a side view of the squeezable nail treatment apparatus, according to one example.

FIG. 1B is a side view of the nail treatment apparatus 100*a*, according to one example, as described by FIG. 1A. In one example, the enclosure 300 may be connected to the squeezable container 400 by screw threads. In another example, the enclosure 300 may be connected to the squeezable container 400 by a press fit. In another example, the enclosure 300 may be formed as one piece with the squeezable container 400.

FIG. 1C is a perspective view of a nail treatment apparatus 100*c*, according to one example. The nail treatment apparatus 100*c* includes an enclosure 300 and a squeezable container 400*c*. An enclosure 300 is disposed at a first end of the squeezable container 400*c*, connected in such a way as to form an airtight seal between the enclosure 300 and the squeezable container 400*c*. The squeezable container 400*c* has a tapered shape along the Y-axis, where the width along the X-axis may differ from the width about the Z-axis, and a second end of the squeezable container 400*c* has a different cross section than that of the first end. Further, the enclosure 300 is shown in a closed position.

Figure 1D:
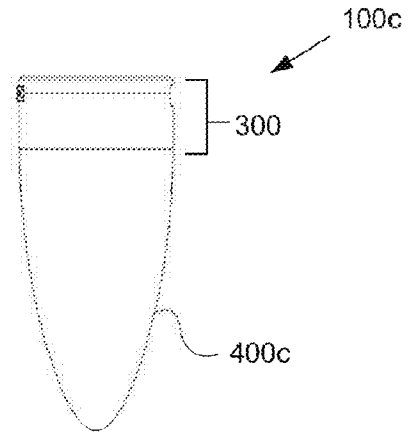
FIG. 1D is a side view of the squeezable nail treatment apparatus, according to one example.

FIG. 1D is a side view of the nail treatment apparatus 100*c*, according to one example, as described by FIG. 1C. In one example, the enclosure 300 may be connected to the squeezable container 400*c* by screw threads. In another example, the enclosure 300 may be connected to the squeezable container 400*c* by a press fit. In another example, the enclosure 300 may be formed as one piece with the squeezable container 400*c*.

FIG. 1E is a perspective view of a nail treatment apparatus 100*e*, according to one example. The nail treatment apparatus 100*e* includes an enclosure 300 and a squeezable container 400*e*. an enclosure 300 is disposed at a first end of the squeezable container 400*e*, connected in such a way as to form an airtight seal between the enclosure 300 and the squeezable container 400*e*. The squeezable container 400*e* has a tapered shape along the Y-axis, where the width along the X-axis may differ from the width about the Z-axis, and a second end of the squeezable container 400*e* is of a different cross section than that of the first end, and also different from the squeezable container 400*c* described by FIG. 1C and FIG. 1D. Further, the enclosure 300 is shown in a closed position.

Figure 1F:
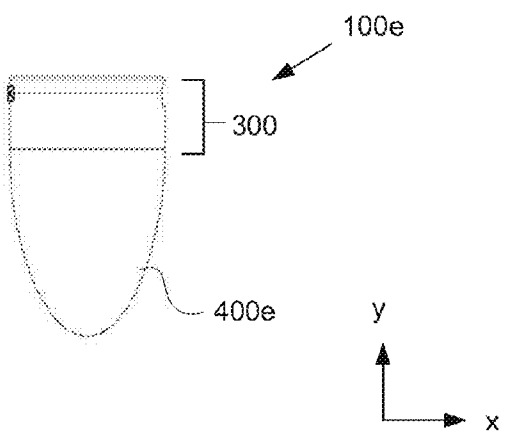
FIG. 1F is a side view of the squeezable nail treatment apparatus, according to one example.

FIG. 1F is a side view of the nail treatment apparatus 100*e*, according to one example, as described by FIG. 1E. In one example, the enclosure 300 may be connected to the squeezable container 400*e* by screw threads. In another example, the enclosure 300 may be connected to the squeezable container 400*e* by a press fit. In another example, the enclosure 300 may be formed as one piece with the squeezable container 400*e*.

The squeezable container 400 (and variations of the squeezable container 400 such as the squeezable containers 400*c* and 400*e*) of FIG. 1A through FIG. 1F are each formed of a pliable, compressible material capable of being pressed or squeezed without damage, and able to hold cosmetic materials, including solvents. The material and design properties of the squeezable container 400 allow for it to be pliable, compressible, malleable, and deformable when additional forces are applied, but the squeezable container 400 is resilient and returns to its nominal shape once the additional forces are no longer applied. Further, the squeezable container 400 may be formed from a variety of materials, for example, polyamide, polymers, a blend of polymers, or from copolymers.

Figure 2A:
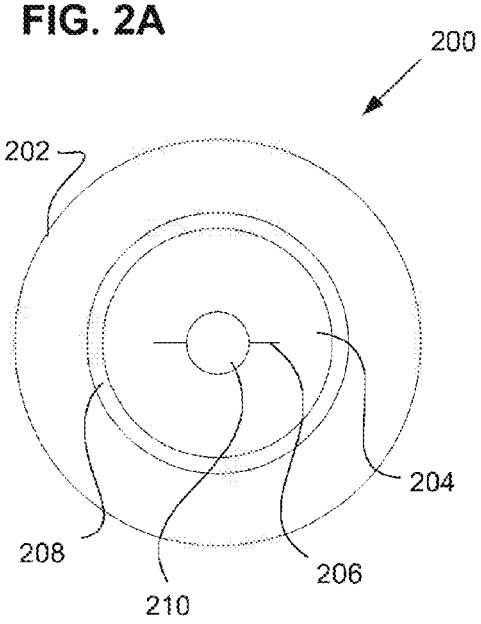
FIG. 2A is a plan view of an insert, according to one example.

FIG. 2A is a plan view of an insert 200, according to one example. The insert 200 is described as viewed from a first end. The insert 200 comprises an inner sponge 204 disposed within an outer sponge 202, both cylindrical in shape, with a gap 208 between an inner circumference of the outer sponge 202 and the outer circumference of the inner sponge 204 at the first end. The gap 208 may extend through to a second end between the outer sponge 202 and the inner sponge 204. The inner sponge 204 may also include a hole 210, a slot 206, or some combination of at least one hole 210 and at least one slot 206 disposed in a variety of positions along the length of the inner sponge 204.

In one example, the inner sponge 204 has approximately the same length as the outer sponge 202, the gap 208 extending through to the second end of the outer sponge 202 and the inner sponge 204.

In another example, the inner sponge 204 has approximately the same length as the outer sponge 202, the gap 208 extending to near the second end of the outer sponge 202 and the inner sponge 204, but not all the way through, resulting in at least one perforation 212 connecting the outer sponge 202 and the inner sponge 204 at the second end.

Further, in any of the examples above, the outer sponge 202 and the inner sponge 204 may also have varying lengths, as may any of the slots 206, the gap 208, and the hole 210.

Each of the slots 206, the gap 208, and the hole 210 may also have cross sections of varying widths, depths, and tapers, and the diameter of the hole 210 may vary over the length of the hole 210. In an embodiment, inner sponges 204 are configured with holes having cross sections of varying widths, depths, and tapers, and diameter of the hole 210 enabling a user to vary the application of a force (e.g., a normal force, a tangential force, a frictional force, and the like) on an object, a finger, a nail, and the like received within the nail treatment apparatuses.

Further, the outer sponge 202 and the inner sponge 204 may be formed of the same material, or of materials having different characteristics. The material may be a porous, low-density polyether or polyester. For example, the outer sponge 202 and the inner sponge 204 may differ in firmness or stiffness, absorption or saturation capabilities, and may react differently to various chemical solutions or compounds. The outer sponge 202 and the inner sponge 204 may be designed for use with specific chemical formulas, and may be saturated with substances such as nail polish remover (solvents), cleaners, moisturizers, nourishment, or other skin or nail care substances. Nail polish removers may be formulated for removal of various types of nail polish such as UV gel, LED gel, water-based nail polish, and solvent-based nail polish.

Further, the inner sponge 204 may have another inner sponge 204 disposed within, forming an insert 200 comprising an outer sponge 202 and multiple inner sponge 204 of various dimensions and materials disposed within the outer sponge 202.

Further, the outer sponge 202 and the inner sponge 204 may have shapes other than cylindrical shapes as described above, for example to match the specific contours of the squeezable container 400, the squeezable container 400*c*, and the squeezable container 400*e*, or any other squeezable container 400.

Figure 2B:
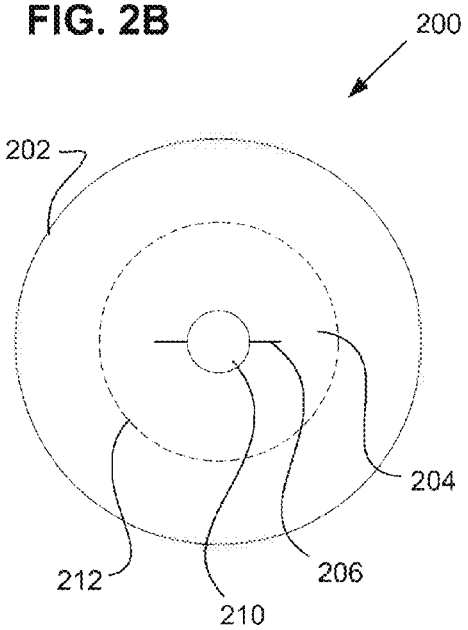
FIG. 2B is a plan view of the insert, according to one example.

FIG. 2B is a plan view of the insert 200, according to one example, The insert 200 described is the same as that of FIG. 2A viewed from the second, opposite end. The second end includes a plurality of perforations 212, the gap 208 tapering from the first end to the second end. In another example, the second end is identical to the first end of FIG. 2A, and the gap 208 is not tapered.

Figure 2C:
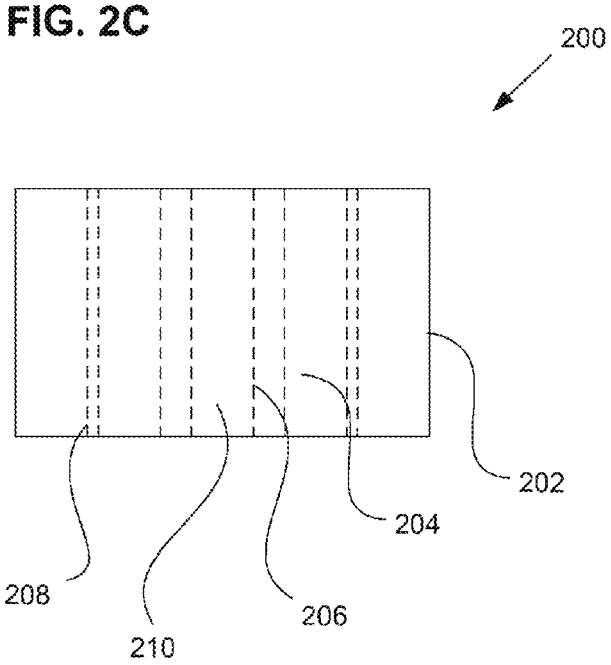
FIG. 2C is a side view of the insert, according to one example.

FIG. 2C is a side view of the insert 200, according to one example. The insert 200 described is the same as that of FIG. 2A viewed from the side.

Figure 3C:
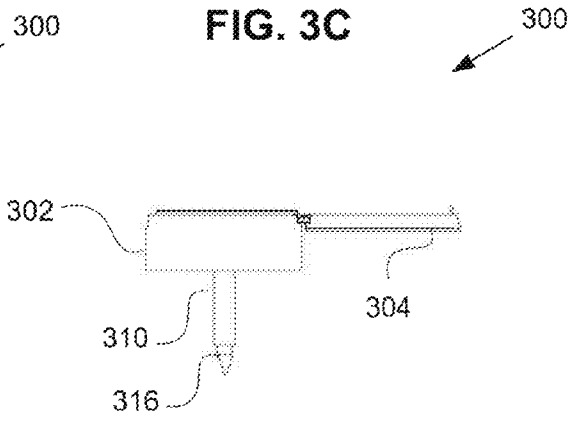
FIG. 3C is a side view of the enclosure, according to one example.
Figure 3B:
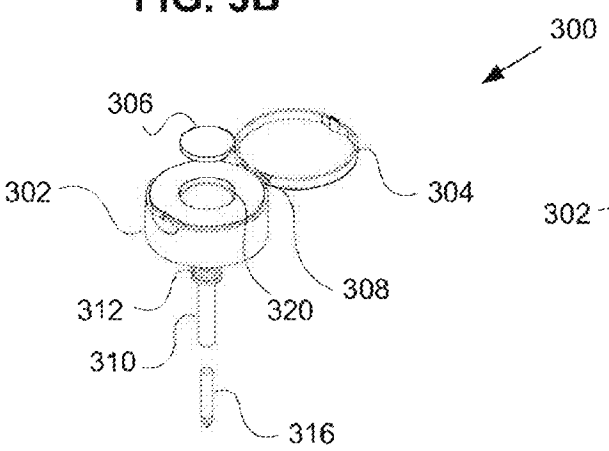
FIG. 3B is an exploded perspective view of the enclosure, according to one example.
Figure 3A:
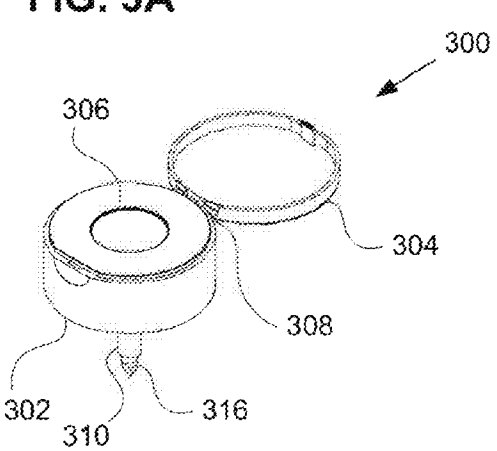
FIG. 3A is a perspective view of an enclosure, according to one example.

FIG. 3A is a perspective view of an enclosure 300, according to one example. The enclosure 300 is shown in an open position and comprises a skirt 302 connected to a cap 304 by a hinge 308, and the skirt 302 is further connected to a removable inner cover 306. The cap 304 may rotate about the hinge 308, forming a tight seal with the skirt 302 when in a closed position. The inner cover 306 is connected to a rod insert 310, and a detail sponge 316 is also connected to the rod insert 310. The detail sponge 316 may be disposed within the rod insert 310. Removal of the inner cover 306 from the enclosure 300 also removes the collar 312 (see FIG. 3B), the rod insert 310, and the detail sponge 316 as they are all connected, and allows material to move through an opening 320 (not visible in this view due to the presence of the 306) formed in the skirt 302 in the absence of the inner cover 306. The enclosure 300 may be connected to the squeezable container 400, the squeezable container 400*c*, or the squeezable container 400*e* in a variety of ways, as described by FIG. 1A, FIG. 1C, and FIG. 1E. In another example, the rod insert 310 may be disposed within the detail sponge 316.

In one example, the detail sponge 316 is used for nail care that requires greater precision than can generally be accomplished using the insert 200, such as removing nail polish or applying nail treatment substances to a portion of a nail. The detail sponge 316 may be comprised of a material that is different from that of the outer sponge 202 and the inner sponge 204, having different material properties, and exhibiting different characteristics such as absorption and saturation capabilities, density, and stiffness.

FIG. 3B is an exploded perspective view of the enclosure 300, according to one example, in an open position such as that described by FIG. 3A. In this view, a collar 312 is also visible. The collar 312 connects the rod insert 310 to the inner cover 306, such that when the inner cover 306 is removed the collar 312, the rod insert 310, and the detail sponge 316 are all removed together. Further, the opening 320 is visible in the absence of the inner cover 306.

FIG. 3C is a side view of the enclosure 300, according to one example, in an open position and identical to that described by FIG. 3A.

Figure 3F:
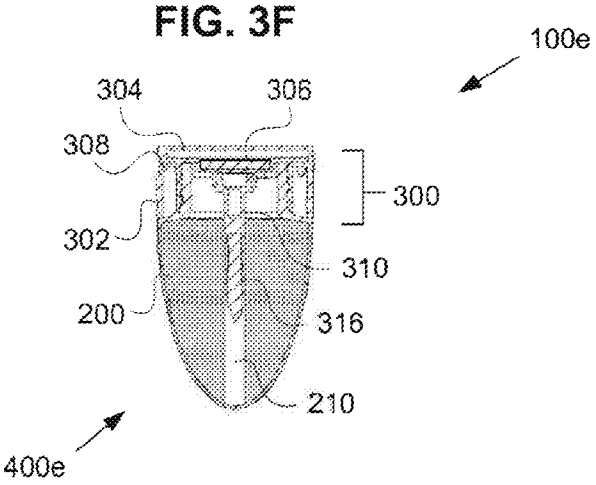
FIG. 3F is a side section view of the enclosure and squeezable nail treatment apparatus, according to one example.
Figure 3E:
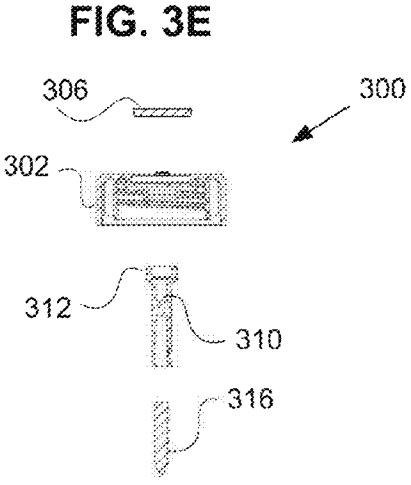
FIG. 3E is a front section view of the enclosure, according to one example.
Figure 3D:
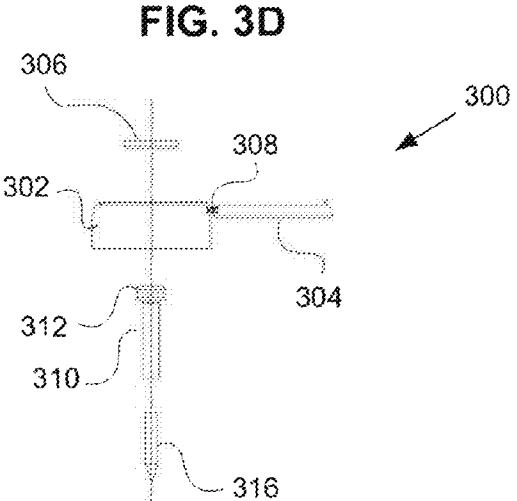
FIG. 3D is an exploded side view of the enclosure, according to one example.

FIG. 3D is an exploded side view of the enclosure 300, according to one example, identical to that described by FIG. 3B.

FIG. 3E is a front section view of the enclosure 300, according to one example, identical to that described by FIG. 3B. The cap 304 and the hinge 308 are not visible in this view.

FIG. 3F is a side section view of the nail treatment apparatus 100*e* comprising the enclosure 300 and the squeezable container 400*e*, according to one example. The enclosure 300 is disposed at a first end of the squeezable container 400*e*, and shown in a closed position, the hinge 308 connected to both the cap 304 and the skirt 302, with the cap 304 disposed above the skirt 302. an insert 200, having a hole 210, is disposed within the squeezable container 400*e*. The inner cover 306, the rod insert 310, and the detail sponge 316 of the enclosure 300 is disposed within the hole 210 of the insert 200.

In one example, the enclosure 300 is connected to the squeezable container 400*e* with screw threads between the skirt 302 and the squeezable container 400*e*.

In another example, the enclosure 300 is connected to the squeezable container 400*e* with a press fit at the skirt 302.

In another example, the enclosure 300 includes a permeable or semi-permeable membrane allowing at least one finger 500 to be inserted into the insert 200, While a finger 500, as a "body part" is shown, another body part may be inserted such as a toe of the user. The enclosure 300 may not require a cap 304 and an inner cover 306 to prevent substances contained within the squeezable container 400 and the insert 200 from flowing out of the nail treatment apparatus 100.

Figure 4A:
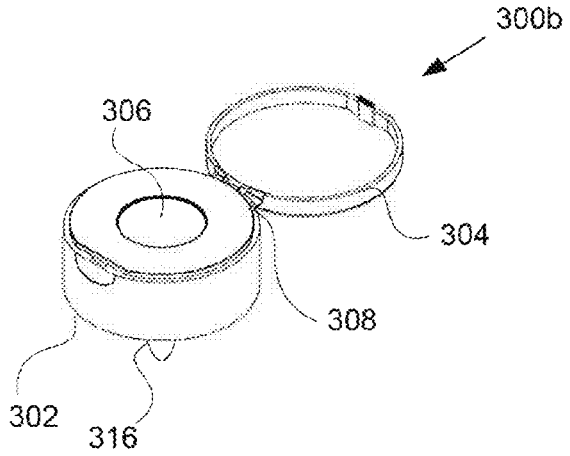
FIG. 4A is a perspective view of an enclosure, according to one example.

FIG. 4A is a perspective view of an enclosure 300*b*, according to one example. The enclosure 300*b* is shown in an open position and comprises a skirt 302 connected to a cap 304 by a hinge 308, and the skirt 302 is further connected to a removable inner cover 306. The cap 304 may rotate about the hinge 308, forming a tight seal with the skirt 302 when in a closed position. The enclosure 300*b* may be connected to the squeezable container 400, the squeezable container 400*c*, or the squeezable container 400*e* in a variety of ways, as described by FIG. 1A through FIG. 1F. In another example, the detail sponge 316*b* may be partially disposed within the substructure 314.

Figure 4B:
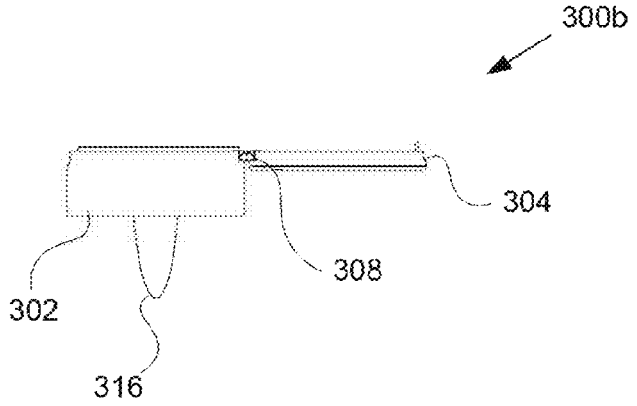
FIG. 4B is a side view of the enclosure, according to one example.

FIG. 4B is a side view of the enclosure 300*b*, according to one example, in an open position. The enclosure 300*b* is the same as that described by FIG. 4A, the inner cover 306 not visible from this perspective.

Figure 4C:
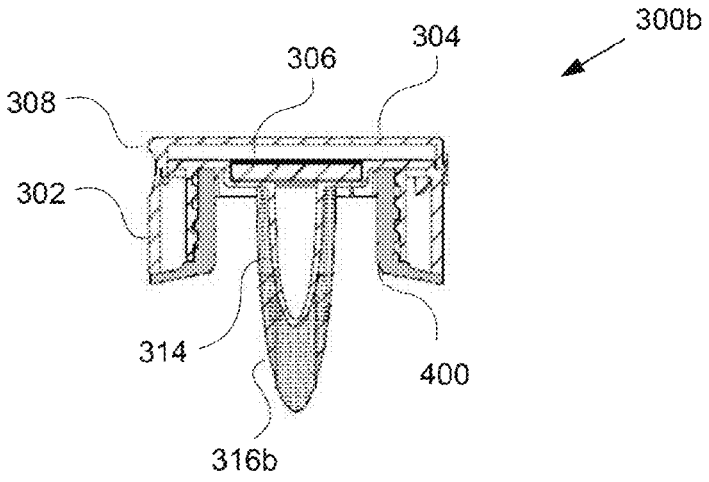
FIG. 4C is a side section view of the enclosure, according to one example.

FIG. 4C is a side section view of the enclosure 300*b*, according to one example. The enclosure 300*b* is the same as that described by FIG. 4A, with a substructure 314 also visible from this perspective and the enclosure 300*b* also connected to a squeezable container 400. The inner cover 306 is connected to a substructure 314, and a detail sponge 316*b* is also connected to the substructure 314. The detail sponge 316*b* may be disposed around the substructure 314. Removal of the inner cover 306 from the enclosure 300*b* also removes the substructure 314 and the detail sponge 316*b* as they are all connected, and allows material to move through an opening 320 (not visible in this view due to the presence of the 306) formed in the skirt 302 in the absence of the inner cover 306.

In one example, the detail sponge 316*b* is used for nail care that requires greater precision than can generally be accomplished using the insert 200, such as removing nail polish or applying nail treatment substances to a portion of a nail. The detail sponge 316*b* may be comprised of a material that is different from that of the outer sponge 202 and the inner sponge 204, having different material properties, and exhibiting different characteristics such as absorption and saturation capabilities, density, and stiffness. The detail sponge 316*b* may be comprised of a different shape and material than the detail sponge 316 described by FIG. 3A.

Figure 5A:
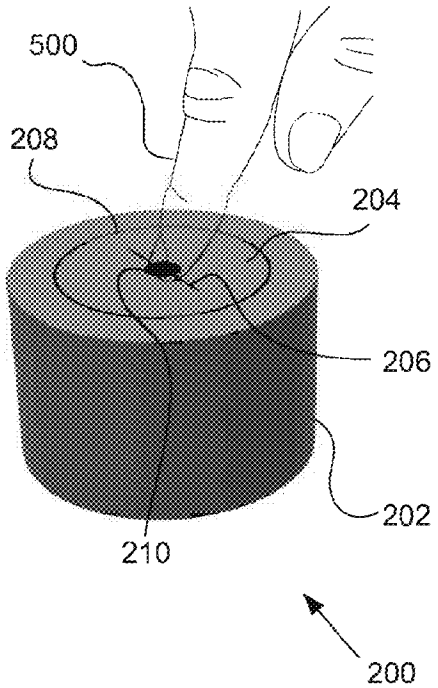
FIG. 5A is a perspective view of a finger inserted into an insert, according to one example.

FIG. 5A is a perspective view of a finger 500 inserted into an insert 200, according to one example. The insert 200 comprises the inner sponge 204 disposed concentrically within the outer sponge 202, the inner sponge 204 including a hole 210, a slot 206, and a gap 208.

In one example, the hole 210 is of a diameter smaller than that of the finger 500, and the slot 206 is disposed across the diameter of the hole 210, As the finger 500 is inserted into the hole 210, material of the inner sponge 204 around the hole 210 is stretched as the hole 210 and the slot 206 expand to form a snug fit with the finger 500. The outer sponge 202 may also stretch as the hole 210 and the slot 206 expand, the gap 208 between the outer sponge 202 and the inner sponge 204 simultaneously becoming smaller. Substances that may be present in the inner sponge 204 and the outer sponge 202 may then be transferred to the finger 500 as part of a process described by FIG. 6A or FIG. 6B.

In one example, during use of the insert 200 a user may move the finger 500 with a rotational, twisting motion within the hole 210 about the Y-axis.

In another example, during use of the insert 200 the user may move the finger 500 with a linear, sliding motion within the hole 210 along the Y-axis.

Figure 5B:
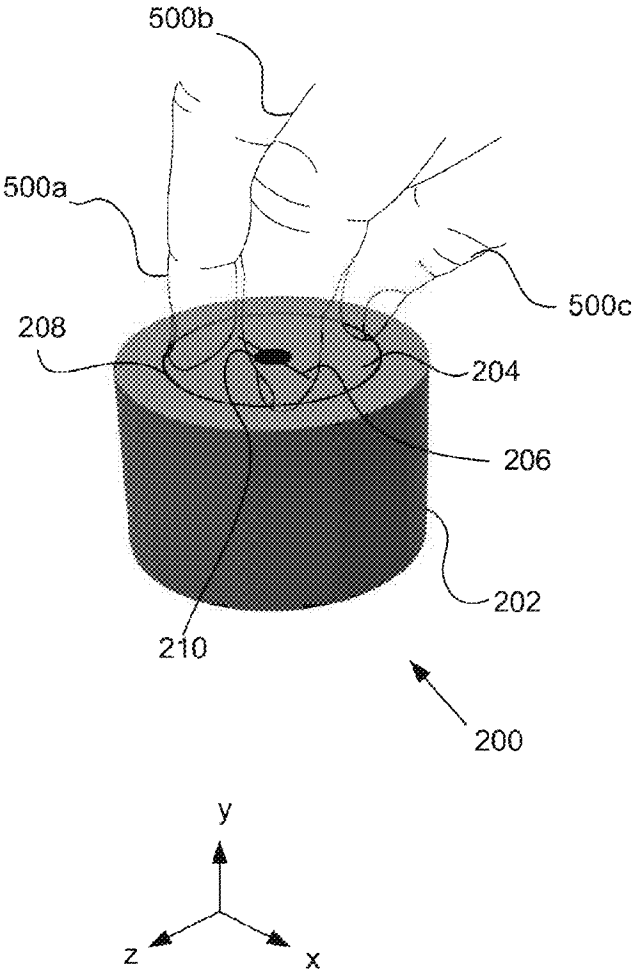
FIG. 5B is a perspective view of a plurality of fingers inserted into the insert, according to one example.

FIG. 5B is a perspective view of a plurality of fingers 500*a*, 500*b*, and 500*c* inserted into the insert 200, according to one example. The insert 200 is identical to that described by FIG. 5A and comprises the inner sponge 204 disposed concentrically within the outer sponge 202, the inner sponge 204 including the hole 210, the slot 206, and the gap 208.

In one example, as the plurality of fingers 500*a*, 500*h*, and 500*c* is inserted into the gap 208, the inner sponge 204 and the outer sponge 202 are compressed as the gap 208 where the finger 500*a*, the finger 500*b*, and the finger 500*c* are inserted expands, forcing the outer sponge 202 apart and the inner sponge 204 to compress such that the outer sponge 202 and the inner sponge 204 form a snug fit with the plurality of fingers 500*a*, 500*b*, and 500*c*. Substances that may be present in the inner sponge 204 and the outer sponge 202 may then be transferred to the plurality of fingers 500*a*, 500*b*, and 500*c* as part of a process described by FIG. 6A or FIG. 6B.

In one example, during use of the insert 200 the user may move the plurality of fingers 500*a*, 500*b*, and 500*c* with a repeating rotational, twisting motion within the gap 208 about an axis.

In another example, during use of the insert 200 the user may move the plurality of fingers 500*a*, 500*b*, and 500*c* with a repeating linear, sliding motion within the gap 208 along an axis.

In another example, the user may insert a different number of fingers 500 than shown in the above examples.

Figure 5C:
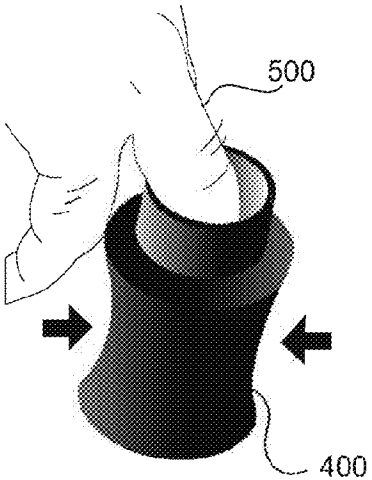
FIG. 5C is a perspective view of a finger inserted into a squeezable nail treatment apparatus, according to one example.

FIG. 5C is a perspective view of the finger 500 inserted into a squeezable container 400, according to one example. An insert 200, as described is disposed within the squeezable container 400, in this case having a form of the squeezable container 400, and the finger 500 is inserted into the hole 210 of the insert 200. In addition to the snug fit formed with the insertion of the finger 500, as described by FIG. 5A and FIG. 5B, additional force may be applied upon the squeezable container 400 as indicated, increasing the pressure applied by the outer sponge 202 and the inner sponge 204 to the finger 500. Greater pressure allows for faster treatment of the finger 500 and reduces the time the finger 500 is exposed to any substances contained within the squeezable container 400.

In another example, the squeezable container 400 has a form of the squeezable container 400*c* (FIG. 1C and FIG. 1D).

In another example, the squeezable container 400 has a form of the squeezable container 400*e* (FIG. 1E and FIG. 1F).

In another example, the squeezable container 400 has a form that allows a plurality of fingers 500 to be inserted such that pressure applied to the squeezable container 400 may apply between the outer sponge 202 and the inner sponge 204 disposed within and the plurality of finger 500 simultaneously.

In another example, the nail treatment apparatus 100 may comprise elements of both the squeezable container 400 and the enclosure 300 in one piece, combined with the insert 200 as described above.

In another example, the nail treatment apparatus 100 may comprise elements of the squeezable container 400 and the insert 200 in one piece, combined with the enclosure 300 as described above.

In another example, the nail treatment apparatus 100 may comprise elements of the squeezable container 400, the enclosure 300, and the insert 200 in one piece.

Figure 6A:
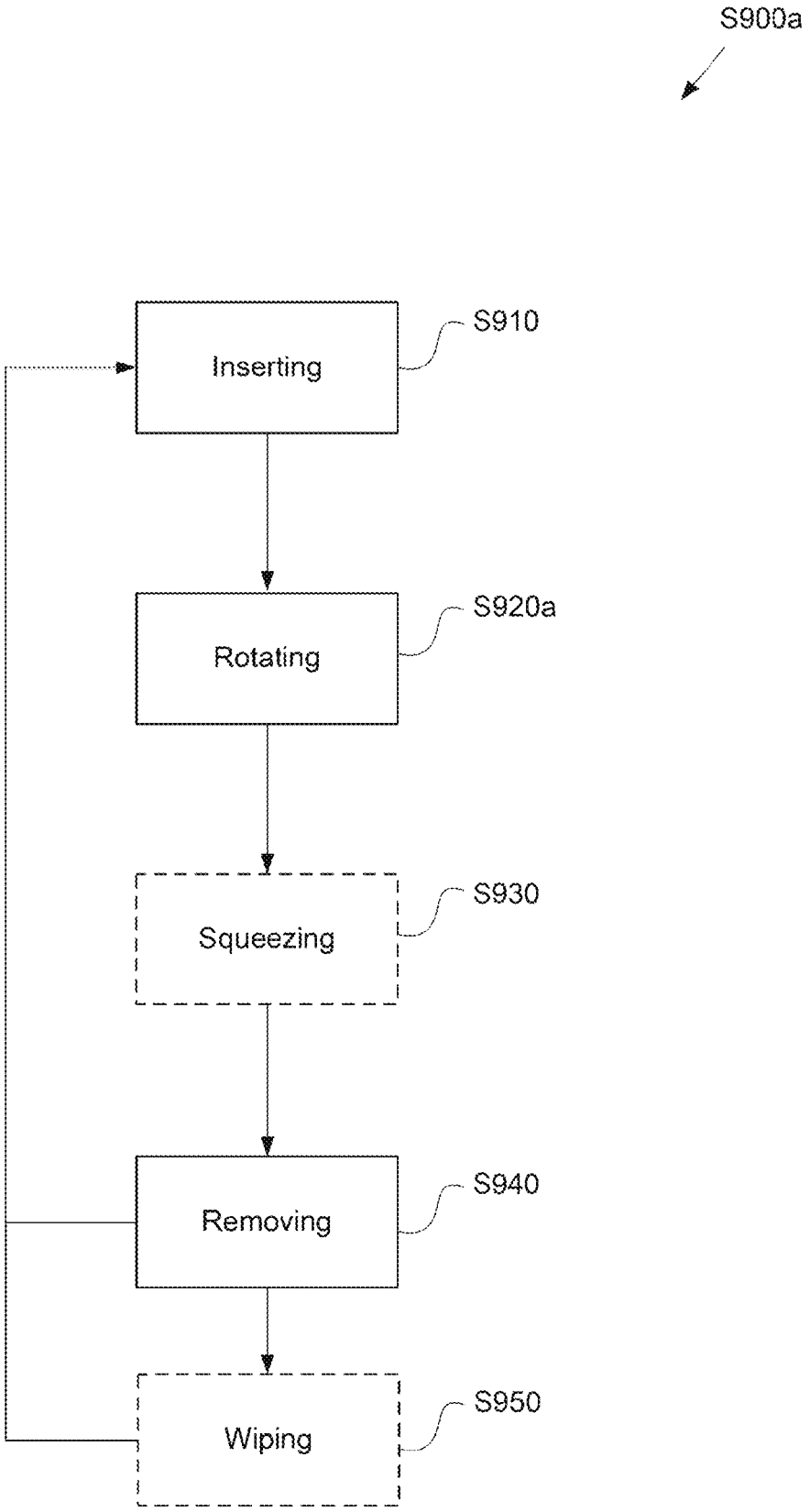
FIG. 6A is a diagram of a nail treatment process using a squeezable nail treatment apparatus, according to one example.

FIG. 6A is a diagram of a nail treatment process S900*a* using a nail treatment apparatus 100, according to one example. The nail treatment process S900*a* includes an inserting process S910, a rotating process S920*a*, an optional squeezing process S930, a removing process S940, and an optional wiping process S950. The steps of the nail treatment process S900*a* are repeated by the user to care for nails as necessary, such as removing nail polish, applying moisturizer, or other skin or nail care substances.

S910 represents a process of inserting at least one finger 500 into the squeezable container 400, the squeezable container 400 having the insert 200 inside, comprising the outer sponge 202 and the inner sponge 204. The inserting process S910 may include steps related to inserting at least one finger 500 into the hole 210 of the inner sponge 204, inserting at least one finger 500 into the gap 208 of the insert 200 between the outer sponge 202 and the inner sponge 204.

Further, the process may include inserting at least one finger 500 into the hole 210 and at inserting least one finger 500 into the gap 208 simultaneously.

S920*a* represents a process of rotating at least one finger 500 within the squeezable container 400, which may include steps related to holding the squeezable container 400 in place and rotating the at least one finger 500 disposed within the insert 200 about an axis (as described by FIG. 5C), the insert 200 disposed within the squeezable container 400. Further, the insert 200 may be fixed to the squeezable container 400 such that rotation of the insert 200 occurs in conjunction with rotation of the squeezable container 400. Alternatively, the insert 200 may further move within the squeezable container 400, relative to the squeezable container 400 such as rotationally or axially.

In another example, the process S920*a* may include steps related to rotating the squeezable container 400 about the at least one finger 500 disposed within the insert 200, the insert 200 disposed within the squeezable container 400.

In another example, the process S920*a* may include steps related to rotating both the squeezable container 400 about at least one finger 500 disposed within the insert 200, the insert 200 disposed within the squeezable container 400, and simultaneously rotating the at least one finger 500 disposed within the insert 200.

S930 represents a process of squeezing at least one finger 500 disposed within the squeezable container 400, which may include steps related to applying a pressure to the squeezable container 400. An external force is applied on one or more sides of the squeezable container 400 to increase pressure upon the insert 200 disposed within the squeezable container 400, thus increasing the pressure applied by the insert 200 upon the at least one finger 500. The increased pressure accelerates the application of any substance contained within the insert 200 and the squeezable container 400 to the at least one finger 500, reducing the time need to care for the at least one finger 500, as well as the time a user and the at least one finger 500 is exposed to said substances through contact and inhalation. The squeezing process S930 is generally performed concurrently with the rotating process S920*a*.

S940 represents a process of removing at least one finger 500 into the squeezable container 400, which may include steps related to pulling the at least one finger 500 disposed within the insert 200 out of the insert 200 and the squeezable container 400. Alternatively, the removing process S940 may include pulling the squeezable container 400 and the insert 200 away from the at least one finger 500 disposed within the insert 200.

S950 represents a process of wiping any substances from the at least one finger 500, which may include steps related to using an additional cloth, paper tissue, or other material to wipe away substances off the at least one finger 500, the substances having been applied to the at least one finger 500 during processes S910 through S940 described above of the nail treatment process S900*a*.

Figure 6B:
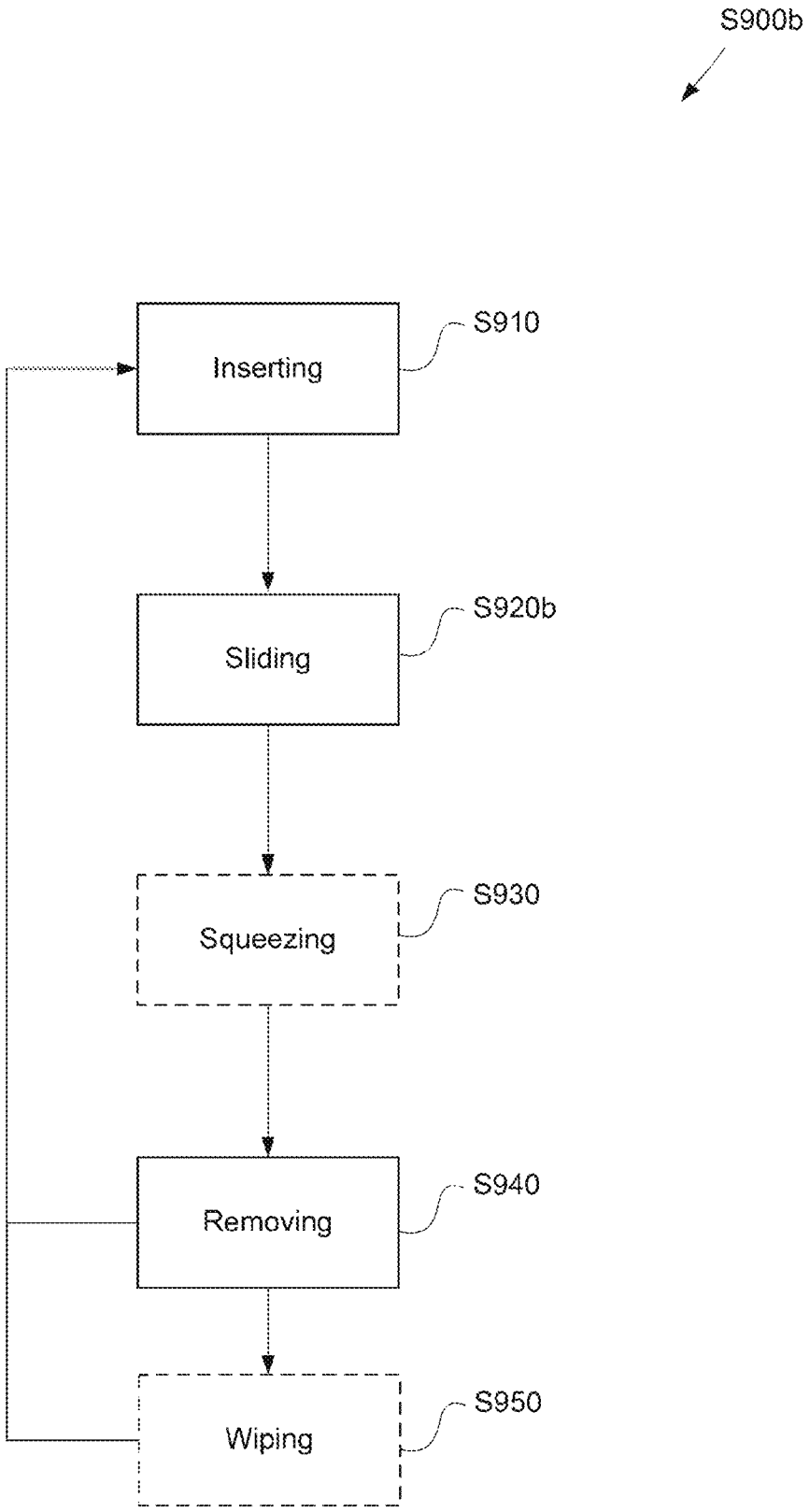
FIG. 6B is a diagram of a nail treatment process using a squeezable nail treatment apparatus, according to one example.

FIG. 6B is a diagram of a nail treatment process S900*b* using a nail treatment apparatus 100, according to one example. The nail treatment process S900*b* includes an inserting process S910, a sliding process S920*b*, an optional squeezing process S930, a removing process S940, and an optional wiping process S950. The steps of the nail treatment process S900*b* are repeated by the user to care for nails as necessary, such as a solvent for removing nail polish, applying moisturizer, or other skin or nail care substances. In one example, the solvent is ethanol acetate.

S910 represents a process of inserting at least one finger 500 into the squeezable container 400, the squeezable container 400 having the insert 200 inside comprising the outer sponge 202 and the inner sponge 204. The inserting process 5910 may include steps related to inserting at least one finger 500 into the hole 210 of the inner sponge 204, inserting at least one finger 500 into the gap 208 of the insert 200 between the outer sponge 202 and the inner sponge 204. Further, the process may include inserting at least one finger 500 into the hole 210 and at inserting least one finger 500 into the gap 208 simultaneously.

S920*b* represents a process of sliding at least one finger 500 within the squeezable container 400, which may include steps related to holding the squeezable container 400 in place and sliding the at least one finger 500 disposed within the insert 200 fore and aft along an axis (as described by FIG. 5C), the insert 200 disposed within the squeezable container 400. Further, the insert 200 may be fixed to the squeezable container 400 such that the sliding motion of the at least one finger 500 within the insert 200 leaves the squeezable container 400 substantially still relative to the insert 200. Alternatively, the insert 200 may further move within the squeezable container 400, relative to the squeezable container 400 such as rotationally or axially, during the sliding motion of the at least one finger 500.

In another example, the process S920*b* may include steps related to sliding the squeezable container 400 about the at least one finger 500 disposed within the insert 200, the insert 200 disposed within the squeezable container 400, and the at least one finger 500 remaining in a substantially still position.

In another example, the process S920*b* may include steps related to sliding both the squeezable container 400 fore and aft along at least one finger 500 disposed within the insert 200, the insert 200 disposed within the squeezable container 400, and simultaneously sliding the at least one finger 500 disposed within the insert 200 such that both the squeezable container 400 and the at least one finger 500 are moving relative to the user.

S930 represents a process of squeezing at least one finger 500 disposed within the squeezable container 400, which may include steps related to applying a pressure to the squeezable container 400. An external force is applied on one or more sides of the squeezable container 400 to increase pressure upon the insert 200 disposed within the squeezable container 400, thus increasing the pressure applied by the insert 200 upon the at least one finger 500. The increased pressure accelerates the application of any substance contained within the insert 200 and the squeezable container 400 to the at least one finger 500, reducing the time need to care for the at least one finger 500, as well as the time the at least one finger 500 is exposed to said substances. The squeezing process S930 is generally performed concurrently with the rotating process S920*a*.

S940 represents a process of removing at least one finger 500 into the squeezable container 400, which may include steps related to pulling the at least one finger 500 disposed within the insert 200 out of the insert 200 and the squeezable container 400. Alternatively, the removing process S940 may include pulling the squeezable container 400 and the insert 200 away from the at least one finger 500 disposed within the insert 200.

S950 represents a process of wiping any substances from the at least one finger 500, which may include steps related to using an additional cloth, paper tissue, or other material to wipe away substances off the at least one finger 500, the substances having been applied to the at least one finger 500 during processes 5910 through S940 described above of the nail treatment process S900*a*.

Figure 7:
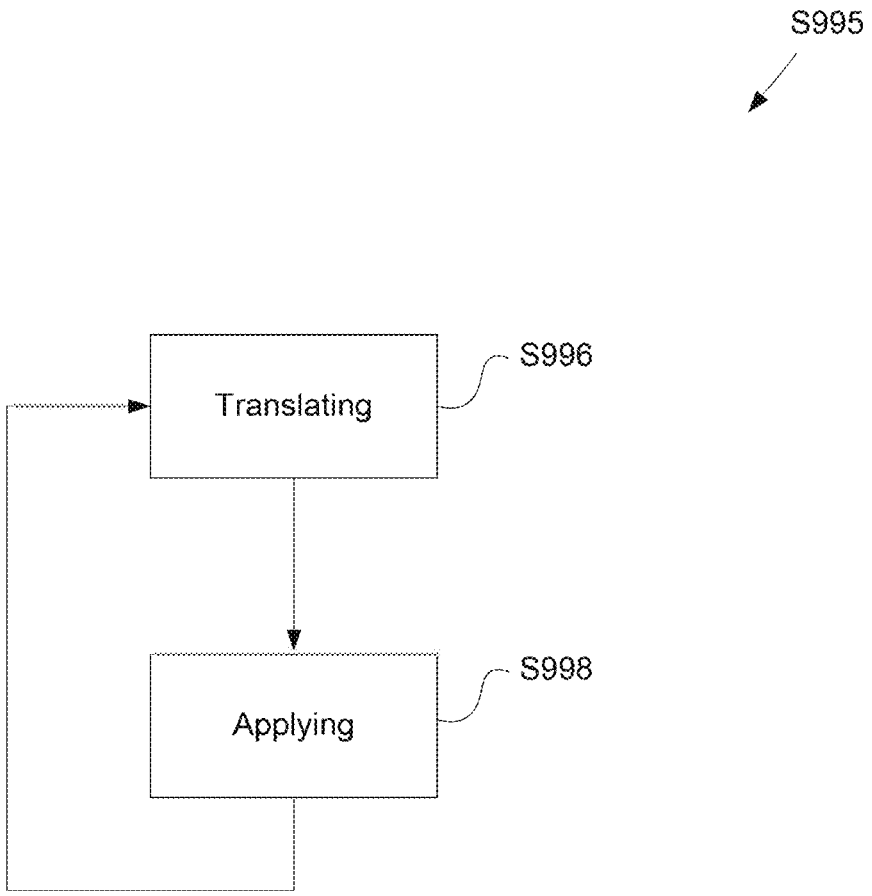
FIG. 7 is a diagram of a nail or skin treatment process using a nail treatment apparatus, according to one example.

FIG. 7 is a diagram of a nail or skin treatment process S995 using a nail treatment apparatus 100, according to one example. The nail treatment process S995 is a method for providing nail or skin treatment to a user, implemented by a nail treatment apparatus 100 that includes a squeezy container 400, is formed from a compressible material, includes an insert 200, disposed within the squeezy container 400 formed of the compressible material, and is configured to receive and surround at least one finger 500 of the user. An opening at a first end of the squeezy container 400 provides access to an interior surface of the insert 200, and the insert 200 is configured to hold at least one substance configured to treat a nail or skin of the user. The method includes a translating process S996 and an applying process S998.

S996 represents a process of translating a compression force received at an outer surface to the insert to compress the insert 200 upon the at least one finger 500 of the user;

S998 represents a process of applying the substance to the at least one finger 500 of the user when the compression force is received.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernable variants of the teachings herein, define, in part, the scope of the foregoing claim terminology such that no inventive subject matter is dedicated to the public.

What is claimed is:

1. An apparatus for providing nail or skin treatment, comprising:

a container, formed of a compressible material;

an insert, disposed within the container formed of a compressible material, and configured to receive and surround at least one body part of a user; and an opening at a first end of the container which provides access to an interior surface of the insert, wherein the insert is configured to hold at least one substance configured to treat at least one of a nail and skin of the user, wherein the insert is made of spongy material, and further includes:

an inner sponge; and an outer sponge, wherein the inner sponge is disposed within the outer sponge, and an interface between an outer surface of the inner sponge and an inner surface of the outer sponge is configured to receive multiple fingers of the user simultaneously and allow movement of the multiple fingers along the interface, the apparatus further comprising a lid assembly configured to connect to the container and cover the opening, and to hold a detail sponge that is disposed within the insert when the lid assembly is connected to the container, the lid assembly further including an outer cap configured to be opened, without being disconnected from the container, to expose an inner cover which secures the detail sponge to the lid assembly, such that removal of the inner cover removes the detail sponge from the lid assembly and exposes a second opening which allows access to the insert and has a smaller width than the opening of the container.

2. The apparatus according to claim 1, wherein the lid assembly further includes:

a rod insert, wherein the rod insert that is configured to support the detail sponge and to protrude away from the opening and into the insert when the lid assembly is attached to the container.

3. The apparatus according to claim 2, wherein the rod insert supports the detailed sponge by attaching to the detailed sponge at a protruding end of the rod insert.

4. The apparatus according to claim 2, wherein the rod insert supports the detail sponge by the detail sponge surrounding a protruding portion of the rod insert.

5. The apparatus according to claim 1, wherein:

the lid assembly is configured to connect to the container by a press fit.

6. The apparatus according to claim 1, wherein:

the lid assembly is configured to connect to the container by screw threads.

7. The apparatus according to claim 1, wherein:

the insert comprises a hole that coincides with the opening of the container and is configured to receive the at least one body part of the user.

8. The apparatus according to claim 1, further comprising at least one slit disposed in the insert, wherein one end of the slit feeds into a hold.

9. The apparatus according to claim 1, wherein:

the compressible material of the container is a polyamide.

10. The apparatus according to claim 1, wherein:

the at least one substance is a solvent.

11. The apparatus according to claim 10, wherein:

the solvent is ethanol acetate.

12. The apparatus according to claim 1, wherein the container is configured to translate a compression force received at an outer surface to the insert to compress the insert upon the at least one body part of the user.

13. The apparatus according to claim 1, wherein the insert is configured to apply the substance to the at least one body part of the user when the compression force is received.

* * * * *